United States Patent [19]

Varlamov et al.

[11] 4,136,971

[45] Jan. 30, 1979

[54] APPARATUS FOR CREATING ACOUSTIC OSCILLATIONS IN A RUNNING LIQUID MEDIUM

[76] Inventors: Vladimir M. Varlamov, ulitsa 50 let Oktyabrya, 1, kv. 16; Anatoly I. Sopin, prospekt Gagarina, 4 linia, 2, kv. 7, both of Zlatoust Chelyabinskoi oblasti; Vasily F. Judaev, ulitsa Polyarnaya, 52, korpus 4, kv. 557, Moscow; Jury P. Romanov, prospekt Gagarina, 2 linia, 3, kv. 78, Zlatoust Chelyabinskoi oblasti; Dmitry T. Kokarev, ulitsa K. Marxa, 21/4, kv. 29, Moscow; Alexandr Z. Metelyagin, ulitsa Dvortsovaya, 14-24, Zlatoust Chelyabinskoi oblasti; Vladislav A. Shestakov, ulitsa Dvortsovaya, 9, kv. 71, Zlatoust Chelyabinskoi oblasti; Vladimir I. Fomin, ulitsa Zelenaya, 30, kv. 67, Zlatoust Chelyabinskoi oblasti; Vladimir A. Filin, prospekt Mira, 20, kv. 58, Zlatoust Chelyabinskoi oblasti, all of U.S.S.R.

[21] Appl. No.: 570,497

[22] Filed: Apr. 22, 1975

[51] Int. Cl.[2] ..... B01F 11/02; B01F 07/28

[52] U.S. Cl. ..... 366/169; 366/171; 366/304; 366/305

[58] Field of Search ..... 259/7, 8, 9, 10, 23, 259/24, 25, 26, DIG. 30, DIG. 43, DIG. 44; 366/169, 171, 176, 262, 303, 304, 305

[56] References Cited

U.S. PATENT DOCUMENTS

| | | | |
|---|---|---|---|
| 2,688,470 | 9/1954 | Marco | 259/DIG. 30 |

FOREIGN PATENT DOCUMENTS

| | | | |
|---|---|---|---|
| 512881 | 8/1952 | Belgium | 259/DIG. 30 |
| 1047176 | 12/1958 | Fed. Rep. of Germany | 259/DIG. 44 |
| 534090 | 10/1955 | Italy | 259/DIG. 44 |
| 698371 | 10/1953 | United Kingdom | 259/DIG. 44 |
| 286973 | 2/1971 | U.S.S.R. | 259/DIG. 30 |

*Primary Examiner*—Richard R. Stearns

*Attorney, Agent, or Firm*—Haseltine, Lake & Waters

[57] ABSTRACT

An apparatus for creating acoustic oscillations in a running liquid medium comprising a stator in the form of a hollow cylinder and a rotor mounted coaxially therewith and comprising a cylinder with closed ends. One of the ends of the rotor has an opening for admitting the liquid medium into the internal space of the rotor which is closed. Rows of apertures are made in the peripheral surface of the rotor and stator, the width of the apertures in the cross-section being selected on the basis of the relationship $$a \leqq \frac{2 \cdot R^2 \cdot \omega}{C}$$

wherein $\omega$ is the angular speed of the rotor,

R is the external radius of the rotor,

C is the speed of propagation of sound in the liquid medium.

6 Claims, 11 Drawing Figures

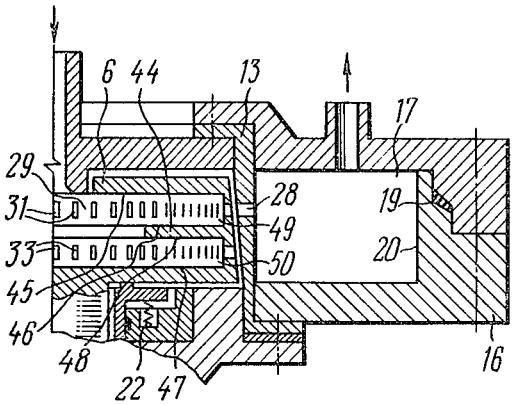
FIG. 7
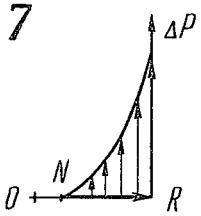
FIG. 11
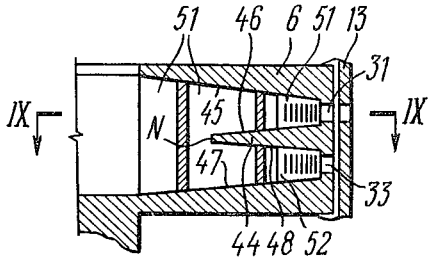
FIG. 8
FIG. 9
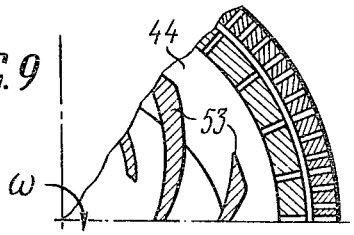

APPARATUS FOR CREATING ACOUSTIC OSCILLATIONS IN A RUNNING LIQUID MEDIUM

BACKGROUND OF THE INVENTION

The present invention relates to the equipment to be used for intensification of physical and chemical processes of affecting the structure of bodies placed in a liquid phase, and more particularly, it relates to an apparatus for creating acoustic oscillations in a running liquid medium to be used mainly for dispergation, emulsification and coagulation of emulsions, solutions, suspensions or homogeneous liquids.

Various apparatus are used for these purposes which create sonic and ultrasonic oscillations in liquid media including those in which the main elements for creating a wave process comprise a rotating rotor and a fixed stator having passages or conduits therein. These apparatus are being permanently improved so as to separate the fundamntal frequency from noises generated due to the caviation phenomenon and to increase the efficiency. The application of such apparatus is, however, limited due to the fact that the frequency of generated oscillations lies predominantly in the low frequency range.

Known in the art is an apparatus for creating acoustic oscillations in a running liquid medium comprising a working chamber accommodating a stator made in the form of a hollow cylinder having a row of apertures in the peripheral surface and a rotor connected to a drive, coaxial with the stator and having a row of apertures in the peripheral surface, a number of apertures of the rotor being by a whole number of times greater than the number of apertures in the stator, and when the apertures of the rotor are brought in register with the apertures of the stator at regular time intervals, the liquid medium admitted to the internal space of the rotor penetrates the working chamber.

In the above-described apparatus the rotor shaft is connected with a rotary drive. The working chamber and the stator are made integral and are closed with a cover having an inlet opening and an outlet openings so that the working chamber comprises a closed space communicating with the internal space of the rotor through the apertures of the stator and rotor and spaces therebetween. Liquid medium is admitted to the internal space of the rotor and is pressed through the apertures of the rotor, space between the rotor and stator, and apertures of the stator into the working chamber having the outlet opening.

The apertures of the stator and rotor are made in the form of slits so that the solid portions between the apertures comprise rods having one end integral with the body of the stator or rotor. It should be noted that the rotor and stator are made with one or several walls and are mounted coaxially relative to each other so that the open end of the stator faces the open end of the rotor, or the end wall of the rotor faces the open end of the stator.

Generation of acoustic oscillations in the above-described apparatus occurs during the rotation of the rotor with the running liquid medium contained in the internal space or spaces thereof, while the row of apertures in the combination rotor/stator are brought in and out of register at regular intervals so that the flow of liquid medium through the apertures is interrupted, while the flow of liquid medium in the rotor and stator remains continuous. With such flow conditions of the running liquid medium, acoustic oscillations are generated in the apparatus, and hydrodynamic cavitation over a large range of acoustic frequencies also develops, said oscillations being transmitted into the working chamber and internal space of the rotor in the form of acoustic pressure waves.

However, this construction of an apparatus for creating (generating) acoustic oscillations in a running liquid medium is rather inefficient for physical and chemical processes of homogenization, dispergation and emulcification. This is due to the fact that the oscillations have a continuous frequency spectrum inherent in hydrodynamic cavitation in a liquid medium. For effecting a specific physical and chemical process powerful acoustic oscillations are required with a selected fundamental frequency corresponding to the optimal conditions of the process. Not only the oscillations are to be provided in the rotor and stator apertures, but they are more important in the internal space or spaces of the rotor and in the working chamber, wherein the major mass of the "sound treated" medium is concentrated. Besides, the cavitation process itself occurring in a liquid medium gives rise to an erosion of metal parts of the apparatus at the liquid solid interface so that the service life of the apparatus is shortened.

It is an object of the present invention to provide in an apparatus for creating acoustic oscillations in a running liquid medium sonic and ultrasonic oscillations at a specified frequency and with maximum amplitude in comparison with component harmonics.

SUMMARY OF THE INVENTION

This object is accomplished due to the fact that in an apparatus for creating acoustic oscillations in a running liquid medium comprising a working chamber accommodating a stator in the form of a hollow cylinder having a row of apertures in the peripheral surface thereof and a rotor connected to a drive disposed coaxially with the stator and having a row of apertures in the peripheral surface thereof, the number of the rotor apertures being greater than that of the stator by a whole number of times so that when the rotor apertures are brought in register with the stator apertures at regular intervals the liquid medium admitted to the internal space of the rotor penetrates the working chamber, according to the invention, the rotor comprises a cylinder with closed ends with one end wall having an opening for admitting the liquid medium to the internal space of the rotor which is closed, and the width of the apertures in the peripheral surface of the rotor and stator in the transverse section is selected on the basis of the relationship $$a \leqq \frac{2 \cdot R^2 \cdot \omega}{C}$$

wherein $\omega$ is angular speed of the rotor,

R is external radius of the rotor,

C is speed of propagation of sound in the running liquid medium

The stator and rotor are preferably provided with at least one additional row of apertures, the apertures of the main and additional rows being arranged coaxially relative to each other in the rotor, and the apertures of the main and additional rows being shifted relative to each other in the stator, whereby the frequency of acoustic oscillations is increased while retaining a specified amplitude of the oscillations.

The apertures of the additional row in the stator are preferably shifted relative to the apertures of the main row at a distance L determined by the relationship $$L = \frac{a + bc}{n},$$

wherein a is width of apertures of the main row in a crosssection bc is a distance between the apertures of the main row as measured along the arc;

n is a number of rows of apertures.

The apertures of the main and additional rows of the stator are preferably arranged in groups non-uniformly distributed over the circumference thereof, the first group of apertures of the additional row being shifted relative to the first group of apertures of the main row, and the second group of apertures of the main row being also shifted relative to the first group of apertures of the additional row at an angle $\eta$ which is selected on the basis of the relationship $$\eta = 2n\left(\frac{1}{Zc \cdot n} + \frac{1}{Zp \cdot k}\right),$$

wherein

Zp is a number of apertures of the main row of apertures of the rotor,

Zc is a number of apertures of the main row of apertures of the stator, $K = \beta \cdot n$ is a number of pressure impulses during the displacement of the rotor through an angle $\phi = 2\pi/Zp$ n is a number of rows of apertures in the stator or rotor, $\beta = Zc/q$ is a number of groups of apertures in the main row of apertures of the stator with $q \leqq Zc/2$ At least one annular projection is preferably provided in the internal space of the rotor which is disposed between the main and additional rows of apertures.

The apparatus for creating acoustic oscillations in a liquid medium according to the invention provides for generation of stable acoustic oscillations with maximum amplitude and at a specified frequency in the range of sonic and ultrasonic frequencies.

BRIEF DESCRIPTION OF THE DRAWINGS

The invention will now be described with reference to specific embodiments thereof illustrated in the accompanying drawings, in which:

FIG. 7 is the fourth embodiment of the apparatus according to the invention in a longitudinal section;

FIG. 8 is a longitudinal section of the fifth embodiment of the apparatus according to the invention;

FIG. 9 is a sectional view taken along the line IX—IX in FIG. 8;

FIG. 11 is a diagram showing the radial distribution of centrifugal forces developed in the internal space of the rotor of the apparatus according to the invention for creating acoustic oscillations in a running liquid medium.

DESCRIPTION OF THE PREFERRED EMBODIMENTS

Figure 1:
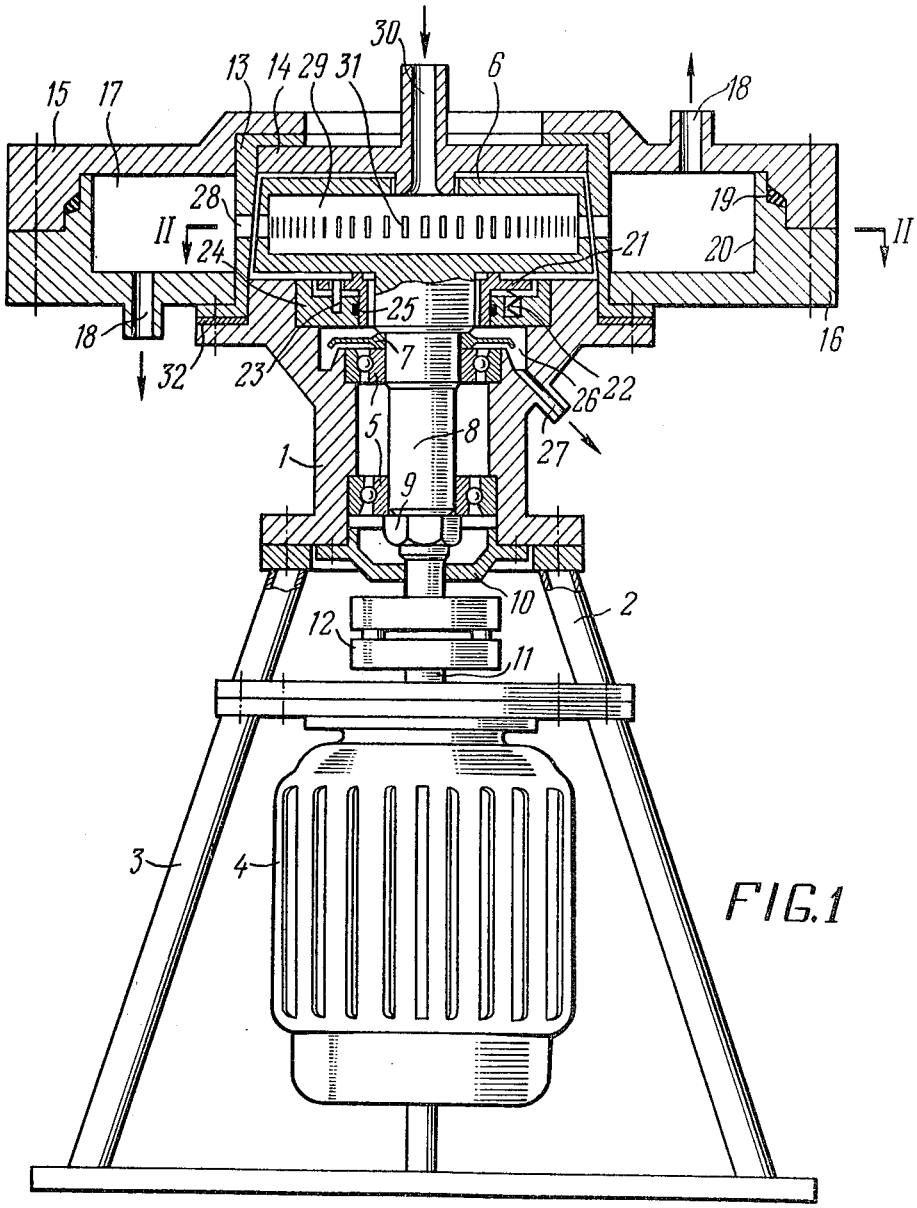
FIG. 1 shows a longitudinal section of an apparatus for creating acoustic oscillations in a running liquid medium according to the invention.

The apparatus for creating acoustic oscillations in a running liquid medium according to the invention comprises a housing 1 (FIG. 1) connected to an intermediate column 2 fixed to the main column 3 having a drive 4 mounted thereto.

The housing 1 accommodates a freely rotatable rotor 6 mounted on bearings 5 and comprising a hollow cylinder with a washer 7 designed to protect the bearings 5 against a liquid medium. A shaft 8 of the rotor 6 is prevented from axially moving relative to the bearings 5 by means of a nut 9. The lower part of the housing 1 is closed with a cover 10 having an opening for the passage of the shaft 8 of the rotor 6 which is coupled to a shaft 11 of the drive by means of a coupling 12.

A stator 13 made in the form of a hollow cylinder is mounted coaxially with the rotor 6. A flange 14 rigidly connected to the stator 13 is located between the stator 13 and the rotor 6, and the stator 13 is, in turn, rigidly connected to the housing 1 and to covers 15 and 16 defining a working chamber 17 and having openings 18 for outlet of a liquid medium which in this specific embodiment is water. The joint between the covers 15 and 16 is provided with a sealing ring 19, and the inner surface 20 of the cover 16 is the surface reflecting acoustic waves.

A sealing bush 21 is in permanent contact with the end face of the rotor 6, and this bush is urged against the rotor 6 by means of springs 22 and is provided with stops 23 preventing it from rotating, the springs 22 and the stops 23 being accommodated in a ring 24 fixed in the housing 1. The bush 21 is sealingly connected to the ring 24 by means of a sealing ring 25 allowing a free vertical displacement of the bush 21.

The housing 1 is provided with an annular space 26 communicating with atmosphere via a passage 27.

As it has been mentioned above, the stator 13 comprises a hollow cylinder, and said cylinder has a row of apertures 28 in the peripheral surface thereof made in the form of slits. The rotor 6 also comprises a cylinder with closed ends defining a closed internal space 29, the upper end wall having an opening mating with a passage 30 of the flange 14 for admitting water to the space 29.

Figure 2:
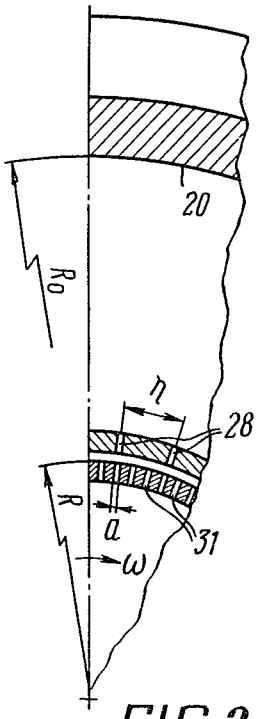
FIG. 2 is a sectional view taken along the line II—II in FIG. 1.

A row of apertures 31 also in the form of slits are made in the peripheral surface of the rotor 6. The number of apertures 31 of the rotor 6 (FIG. 2) is greater than the number of apertures 28 of the stator 13 by a whole number of times, and the width "a" of apertures 28 and 31 in the cross-section is selected on the basis of the relationship $$a \leqq \frac{2 \cdot R^2 \cdot \omega}{C}, \quad \text{(I)}$$

wherein $\omega$ is angular speed of the rotor 6,

R is external radius of the rotor 6,

C is rate of propagation of sound in the running liquid medium.

This relationship is derived from the condition providing for obtaining a direct surging shock in the internal space 29 of the rotor 6 and in the working chamber 17 where the time t, during which the apertures 28 of the stator 13 are closed by the solid portions between the apertures 31 of the rotor 6, is shorter or equal to the time 2(Ro-R)/c required for direct and return travel of the pressure wave front from the aperture 28 to the surface 20 and backwards, that is $$t \leqq \frac{2(Ro - R)}{c}$$

wherein $R_o$ is radius of the surface 20.

The outer surface of the rotor 6 (FIG. 1) and the inner surface of the stator 13 are inclined with respect to their rotational axes. This is explained by the fact that a space should be provided between these surfaces to create appropriate conditions for operation of the apparatus. The amount of this space is determined and adjusted by displacing the stator 13 together with the flange 14 and covers 15 and 16 axially by adjusting the thickness of a ring 32 placed between the stator 13 and the housing 1, the thickness of the ring being proportional to the amount of this space.

There is another embodiment of the apparatus similar to that described above.

Figure 4:
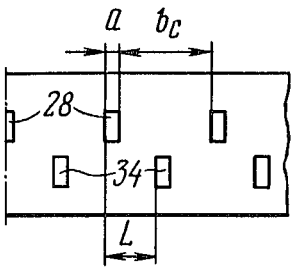
FIG. 4 is a developed view of the second embodiment of the apparatus showing a part of the stator.
Figure 3:
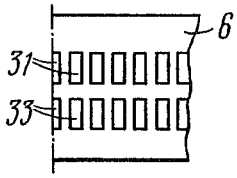
FIG. 3 is a developed view of a part of the rotor shown in FIG. 1.

This embodiment is characterized in that the rotor 6 is provided with an additional row of apertures 33 (FIG. 3), the apertures 31 of the main row and the apertures 33 of the additional row being coaxial relative to each other. The stator 13 is also provided with an additional row of apertures 34 (FIG. 4), the apertures 28 and 34 are arranged in such a manner as to ensure an increase in the fundamental frequency of acoustic oscillations while retaining the amplitude thereof.

This is achieved due to the fact that the apertures 34 of the additional row of apertures of the stator 13 are shifted relative to the apertures 28 of the main row at a distance L determined from the relationship $$L = \frac{a + bc}{n} \quad \text{(II)}$$

wherein a is width of the apertures 28 of the main row in the cross-section;

bc is a distance between the apertures 28 of the main row as measured along the arc, n is number of rows of apertures which is equal to 2 in this specific embodiment.

There is the third embodiment of the apparatus similar to that described above.

This embodiment is characterized in that the apertures of the main row of apertures 28 and the apertures of the additional row of apertures 34 of the stator 13 (FIG. 1) are arranged in groups non-uniformly distributed over the peripheral surface of the stator. It should be noted that in each group, the apertures are equally spaced with an angular pitch between the adjacent apertures of the same group $$\alpha = 2\pi/q$$

wherein q is number of apertures in a group.

Figure 5:
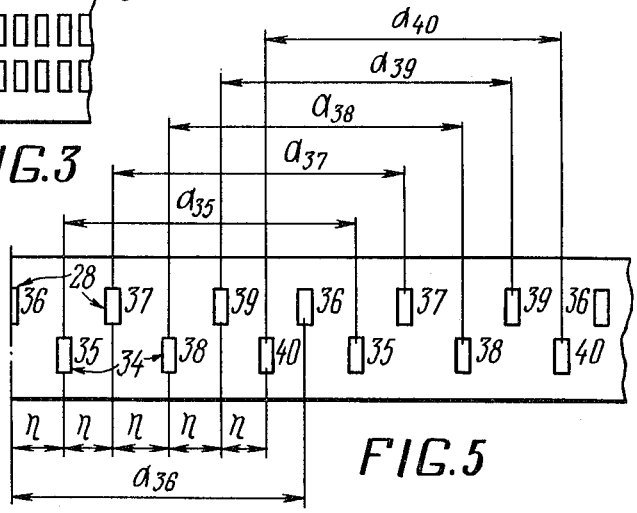
FIG. 5 is a developed view of a parts of the stator in the third embodiment of the apparatus.

A group $\alpha_{35}$ (FIG. 5) of apertures 35 of the additional row of apertures 34 is shifted relative to a group $\alpha_{36}$ of apertures 36 of the main row of apertures 28, and a group $\alpha_{37}$ of apertures 37 of the main row of apertures 28 is also shifted relative to the group $\alpha_{35}$ of apertures 35 of the additional row of apertures 34 at an angle $\eta$ determined from the relationship $$\eta = 2\pi\left(\frac{1}{Zc \cdot n} + \frac{1}{Zp \cdot k}\right) \quad \text{(III)}$$

wherein

Zp is a number of apertures of the main row of apertures 31 of the rotor 6, Zc is a number of apertures of the main row of apertures 28 of the stator 13, $K = \beta \cdot n$ is a number of pressure impulses during the displacement of the rotor 6 through an angle $\phi = 2\pi/Zp$ n is a number of rows of apertures in the stator 13 or rotor 6, $\beta = Zc/q$ is a number of groups $\alpha$ of apertures in the main row of apertures 28 of the stator 13 with $\alpha$ which is equal to 3 in this specific embodiment of the apparatus.

A group $\alpha_{38}$ of apertures 38 of an additional row of apertures 34 is also shifted relative to the group $\alpha_{37}$ of apertures 37 of the main row of apertures 28, and a group $\alpha_{39}$ of apertures 39 of the main row of apertures 28 is shifted relative to the group $\alpha_{38}$ also at the angle $\eta$. Similarly, a third group $\alpha_{40}$ of apertures 40 of the additional row of apertures 34 is shifted relative to the group $\alpha_{39}$.

Figure 6:
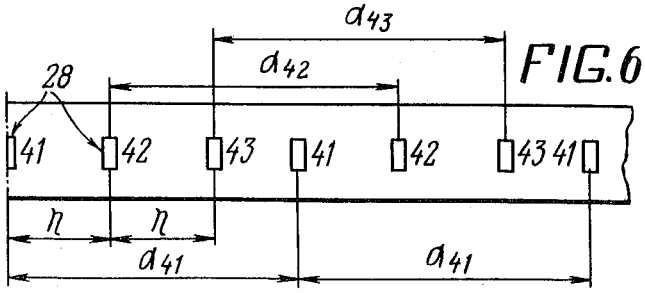
FIG. 6 is a developed view of a part of the stator with a single row of apertures corresponding to the embodiment illustrated in FIG. 5.

It follows from the above-given relationship (III) that with n = 1 the apertures arranged in groups may be made in a single row, the number of groups in this embodiment being also equal to three: $\alpha_{41}$ (FIG. 6), $\alpha_{42}$ and $\alpha_{43}$.

The arrangement of apertures in the stator 13 (FIG. 1) and rotor 6 in accordance with all the above-described embodiments provides for obtaining a fundamental frequency of pressure impulses in the working chamber 17 and in the internal space 29 of the rotor 6 which is determined by the relationship $$f = \frac{m \cdot Zp \cdot k}{60}$$

wherein m is a number of revolutions per minute of the rotor 6.

The fourth embodiment of the apparatus for creating acoustic oscillations in a running liquid medium according to the invention is similar to those above described.

This embodiment is different in that the stability of pressure impulses is ensured due to the provision of an annular projection 44 (FIG. 7) in the internal space 29 of the rotor 6, the projection being located between the main row 31 of apertures and the additional row 33 of apertures of the rotor 6. Thus, the inner surface 45 of the rotor 6 and the surface 46 of the annular projection 44, as well as the corresponding surfaces 47 and 48 define spaces 49 and 50, respectively.

In order to obtain maximum amplitude of pressure impulses, the above-mentioned surfaces 45, 46, 47 and 48 are inclined with respect to the periphery of the rotor 6 (FIG. 8) to provide conical spaces 51 and 52. However, the shape of these spaces may be more intricate so as to ensure a constant flow rate of liquid medium in the rotor 6.

The fifth embodiment of the apparatus is similar to those described above.

The difference lies in that impeller pump blades 53 (FIG. 9) are mounted in the spaces 51 and 52 of the rotor 6 so as to provide for a self-induced suction-in of the liquid medium and to build-up a pressure of liquid medium in these spaces. The provision of the blades 53 is also advisable with the arrangement of apertures in the rotor 6 and stator 13 in a single row (FIG. 1).

The sixth embodiment of the apparatus is similar to those described above.

This embodiment is different in that the working chamber 54 (FIG. 10) is formed by the cover 16 and a cylinder 55. This embodiment permits to respeatedly subject the liquid medium in the chamber 54 to the action of acoustic oscillations.

The apparatus for creating acoustic oscillations in a running liquid medium according to the invention functions in the following manner.

A liquid medium is supplied to the apparatus through the passage 30 (FIG. 1) and fills the internal space 29 of the rotor 6 under a pumping pressure. Then the liquid medium fills, via the apertures 31 of the rotor 6, the space between the rotor 6 and the stator 13, as well as the working chamber 17 through the apertures 28 of the stator 13, wherefrom the liquid medium flows out through the openings 18 in the covers 15 and 16 also under pressure.

The pressure in the space between the rotor 6 and stator 13 provides for urging the sealing bush 21 against the end face of the rotor 6 thereby ensuring its tight engagement with this end face and sealing of the space 29 and working chamber 17.

The drive 4 imparts a rotary motion to the rotor 6 at a preselected angular speed $\omega$. Thus a pressure is developed in the internal space 29 of the rotor 6 which is created by a centrifugal force proportional to the second power of the product of the angular speed $\omega$ by the external radius R of the rotor 6.

In case of a negligible leakage of the liquid medium through the end seal between the bush 21 and rotor 6, the leakage is directed, by means of the washer 7, to the annular space 26 wherefrom the liquid medium is removed from the apparatus through the passage 27.

Due to the fact that the internal space 29 of the rotor 6 is closed, an increment of the radial pressure therein increases in the direction towards the periphery of the rotor 6.

For a better understanding of operation of the apparatus according to the invention, FIG. 11 shows a diagram of radial distribution of centrifugal forces, wherein increments of radial pressure $\Delta P$ are plotted on the ordinates, and the radius R of the rotor 6 is plotted on the abscissa.

During the rotation of the rotor 6, the apertures 28 of the stator 13 are closed by solid portions between the apertures 31 of the rotor 6 at regular intervals and are opened when brought in register with the apertures 31. Thus the flow rate of the liquid medium at the outflow from the internal space 29 into the working chamber 17 cyclically varies in time which is necessary for creation of a wave process both in the internal space 29 of the rotor 6 and in the working chamber 17.

The rotational speed of the rotor 6 is such that the time of displacement of one aperture 31 of the rotor 6 between two adjacent apertures 28 of the stator 13 is sufficient for the restoration of maximum radial pressure $\Delta P$.

As shown in the relationship (I), the width of the apertures 28 and 31 in the cross-section is selected to fulfill the conditions for direct surging shock in the internal space 29 of the rotor 6 and in the working chamber 17. Therefore, acoustic oscillations are created in the liquid medium in the following manner.

At the instant where the apertures 28 of the stator 13 are brought in register with the apertures 31 of the rotor 6, a reduced pressure wave front appears in the internal space 29 of the rotor 6, and an elevated pressure wave front appears in the working chamber 17.

At the instant where the apertures 28 of the stator 13 are out of register with the apertures 31 of the rotor 6, the kinetic energy of the running liquid medium is converted into the potential energy of compression of the medium in the internal space 29 of the rotor 6 and pressure reduction in the medium in the working chamber 17. This results in the propagation of pressure waves, that is acoustic waves. This process is repeated at a frequency $f = \omega Zp/2\pi$ Due to the fact that the surface 20 of the cover 16 is located at a distance of a whole number of half-wave lengths from the surface of the rotor 6 and reflects the acoustic waves in an appropriate phase coinciding with the phase of repeatedly appearing waves, there are provided the conditions of resonance oscillations in the working chamber 17, and the amplitude of acoustic pressure waves attains its maximum. The progagation of pressure impulses concurrently from all the apertures 28 of the stator 13 also contributes to the provision of the resonance conditions.

Acoustic oscillations are created in the other embodiments of the apparatus in the similar manner.

The second embodiment of the apparatus is different in that the number of pressure impulses per one revolution of the rotor 6 is increased proportionally to the number of rows of apertures in the rotor 6 and stator 13. The propagation of pressure impulses is provided in turn by all apertures 28 of the main row (FIG. 4) and then by all apertures 34 of the additional row of the stator 13.

The third embodiment of the apparatus is different in that the number of pressure impulses per one revolution of the rotor 6 is increased proportionaly to the product of the number of rows by the number of groups of apertures non-uniformly distributed over the peripheral surface of the stator 13. The propagation of pressure impulses is also provided in turn by all apertures 36 (FIG. 5) of the group $\alpha_{36}$, then by all apertures 35 of the group $\alpha_{35}$, then by all apertures 37 of the group $\alpha_{37}$, by apertures 38 of the group $\alpha_{38}$, apertures 39 of the group $\alpha_{39}$ and apertures 40 of the group $\alpha_{40}$. With the arrangement of apertures in the apparatus in a single row, the propagation of pressure impulses is effected in turn by all apertures 41 (FIG. 6) of the group $\alpha_{41}$, then apertures 42 of the group $\alpha_{42}$ and apertures 43 of the group $\alpha_{43}$.

As mentioned above, the stability of pressure impulses as regards the amplitude of acoustic oscillations in the second and third embodiments of the apparatus is ensured by the provision of the annular projection in the internal space 29 of the rotor 6 (FIG. 7) which divides the space 29 into two spaces 49 and 50. Maximum radial pressure ΔP of centrifugal forces is restored in each aperture 31 and 33 of the main and additional rows of apertures of the rotor 6 divided by the projection 44 during the displacement between two adjacent apertures 28 (FIGS. 4 and 5) and 34 of the main and additional rows of apertures of the stator 13 (FIG. 7) independently of fluctuations of radial pressure in the apertures of another row of apertures of the rotor 6 separated by the projection 44.

The increment of radial pressure ΔP shown in FIG. 11 increases from zero up to the maximum value. The zero value of ΔP corresponds to the point N (FIG. 8) and the maximum value of the outer cylindrical surface of the rotor 6.

In the fourth embodiment of the apparatus, wherein the surfaces 45, 46 and 47, 48 are inclined with respect to the periphery of the rotor 6, the flow rate of the liquid medium at the portion N-R (FIG. 11) of the increment of radial pressure created by centrifugal forces remains unchanged.

The provision of the impleller pump blades 53 (FIG. 8) in the internal spaces 51, 52 of the rotor 6 ensures the creation in these spaces of static pressure of the liquid medium, under which the liquid medium overflows into the working chamber 17, while the provision of the working chamber 54 (FIG. 10) in the form of a hollow cylinder permits the liquid medium to be repeatedly and continuously subjected to the action of acoustic waves.

Figure 10:
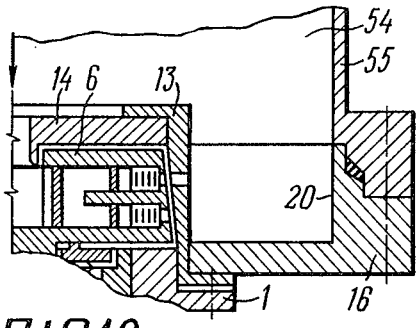
FIG. 10 is a longitudinal section of the sixth embodiment of the apparatus according to the invention.

In all the embodiments of the apparatus there are standing waves of acoustic oscillations over the entire volume of liquid medium in the working chamber 17 (FIG. 1) or 54 (FIG. 10).

The apparatus for creating acoustic oscillations in a running liquid medium according to the invention is substantially different in comparison with the known apparatus intended for similar purposes, the difference consisting in that the apparatus according to the invention uses the phenomenon of direct surge shock in the running liquid medium in combination with an increment of pressure created by centrifugal forces and speed of mechanical action on the running liquid medium.

The construction of the apparatus according to the present invention permits powerful acoustic oscillations at a specified working frequency selected from a wide frequency range to be present in a liquid medium. This is very important for intensification of various physical and chemical processes.

What is claimed is:

1. An apparatus for creating acoustic oscillations in a running liquid medium comprising: a working chamber; openings in said working chamber for outlet of said liquid medium; a stator in the form of a hollow cylinder in said working chamber; a row of apertures in the peripheral surface of said stator; a rotor in the form of a cylinder with closed ends in said working chamber coaxially with said stator; a closed internal space of said rotor; an opening in one of said ends of said rotor for admitting said running liquid medium to said internal space of said rotor; a row of apertures in the peripheral surface of said rotor, the number of said apertures of the rotor being greater than the number of said apertures in the peripheral surface of said stator by an integral factor so that when said apertures of said rotor are brought in register with said apertures of said stator at regular intervals, said running liquid medium is admitted from said closed internal space to said working chamber, the width a of said apertures in the peripheral surface of said rotor and stator in the cross-section being selected on the basis of the relationship $$a \leqq \frac{2 R^2 \omega}{C}$$

wherein $\omega$ is the angular speed of said rotor,

R is the external radius of said rotor,

C is the rate of propagation of sound in said running liquid medium.

2. An apparatus according to claim 1, comprising: an additional row of apertures in the peripheral surface of said rotor arranged coaxially with said apertures of the main row; an additional row of apertures in the peripheral surface of said stator shifted relative to said apertures of the main row of apertures thereof, whereby the frequency of acoustic oscillations is increased while retaining a specified amplitude of the oscillations.

3. An apparatus according to claim 2, wherein said apertures of said additional row of apertures of said stator are shifted relative to said apertures of the main row of apertures at a distance L determined from the relationship $$L = \frac{a + bc}{n},$$

wherein a is the width of said apertures of the main row of apertures in the cross-section, bc is the distance between said apertures of the main row of apertures as measured along the arc, n is the number of rows of said apertures.

4. An apparatus according to claim 3, comprising an annular projection in said internal space of said rotor located between said main and additional rows of said apertures.

5. An apparatus for creating acoustic oscillations in a running liquid medium comprising: a working chamber; openings in said working chamber for outlet of said liquid medium; a stator in the form of a hollow cylinder in said working chamber; a row of apertures in the peripheral surface of said stator; a rotor in the form of a cylinder with closed ends in said working chamber coaxially with said stator; a closed internal space of said rotor; an opening in one of said ends of said rotor for admitting said running liquid medium to said internal space of said rotor; a row of apertures in the peripheral surface of said rotor, the number of said apertures of the rotor being greater than the number of said apertures in the peripheral surface of said stator by an integral factor so that when said apertures of said rotor are brought in register with said apertures of said stator at regular intervals, said running liquid medium is admitted from said closed internal space to said working chamber, the width a of said apertures in the peripheral surface of said rotor and stator in the crosssection being selected on the basis of the relationship $$a \leqq \frac{2 \cdot R^2 \cdot \omega}{C}$$

wherein $\omega$ is the angular speed of said rotor,

R is the external radius of said rotor,

C is the speed of propagation of sound in said running liquid medium; an additional row of apertures in the peripheral surface of said rotor arranged coaxially with said apertures of the main row; an additional row of apertures in the peripheral surface of said stator shifted relative to said apertures of the main row of apertures thereof, whereby the frequency of acoustic oscillations is increased while retaining a specified amplitude of the oscillations; the apertures of said main row and the apertures of said additional row of the stator are arranged in groups distributed at unequal intervals along the circumference of the stator; the apertures in each of said groups being disposed at an identical spacing from one another along the circumference of said stator; a first group of apertures of said additional row shifted relative to a first group of said main row, and each successive group of said main row and additional row being shifted relative to a preceding group of apertures of the additional row and main row, respectively, at an angle determined by the relationship $$\eta = 2\pi\left(\frac{1}{Zc \cdot n} + \frac{1}{Zp \cdot k}\right)$$

where Zp is the number of apertures in the main row of apertures of the rotor; Zc is the number of apertures in the main row of apertures of the stator; $K = \beta n$ is the number of pressure pulsations as the rotor moves through an angle $\phi = 2\pi/Zp$; n is the number of rows of apertures of the rotor; $\beta = Zc/q$ is the number of groups of apertures in the main row of apertures of the stator, where $q \leqq Zc/2$.

6. An apparatus according to claim 5, comprising an annular projection in the internal space of said rotor located between said main and additional row of said apertures.

* * * * *